US006945068B2

(12) United States Patent
Kim et al.

(10) Patent No.: US 6,945,068 B2
(45) Date of Patent: Sep. 20, 2005

(54) REFRIGERATOR WITH AN ICEMAKER

(75) Inventors: Seong Jae Kim, Gyeonggi-do (KR); Myung Ryul Lee, Gyeonggi-do (KR); Chang Ho Seo, Seoul (KR); Sune Hoon Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/769,801

(22) Filed: Feb. 3, 2004

(65) Prior Publication Data

US 2005/0061018 A1 Mar. 24, 2005

(30) Foreign Application Priority Data

Sep. 19, 2003 (KR) ..... 10-2003-0065162

(51) Int. Cl.[7] ..... F25C 1/00
(52) U.S. Cl. ..... 62/353; 62/426
(58) Field of Search ..... 62/66–74, 340–356, 62/414, 419, 426

(56) References Cited

U.S. PATENT DOCUMENTS 3,146,601 A * 9/1964 Gould ..... 62/3.6
3,151,472 A * 10/1964 Harle et al. ..... 62/391
3,350,899 A * 11/1967 Jones et al. ..... 62/414
5,729,997 A * 3/1998 Witsoe ..... 62/407
6,050,097 A 4/2000 Nelson et al.
6,082,130 A 7/2000 Pastryk et al.
6,148,624 A 11/2000 Bishop et al.
6,286,324 B1 9/2001 Pastryk et al.
6,314,745 B1 11/2001 Janke et al.
6,351,958 B1 3/2002 Pastryk et al.
6,438,988 B1 * 8/2002 Paskey ..... 62/353
6,735,959 B1 * 5/2004 Najewicz ..... 62/3.63

* cited by examiner

*Primary Examiner*—William E. Tapolcai
(74) *Attorney, Agent, or Firm*—Birch, Stewart, Kolasch & Birch, LLP

(57) ABSTRACT

Disclosed is a refrigerator having an improved structure for supplying ice to an outside through a dispenser provided at a door. A cabinet includes a freezer and a cooling chamber. A case having a cavity therein is provided at the door opening and closing the cooling chamber. A first duct is provided in the cabinet for supplying cool air generated around the evaporator to the cooling chamber and a second duct is provided in the cabinet for supplying the cool air to the cavity. The icemaker is provided at the cavity for producing ice and the ice container is provided at the cavity for storing the ice. The dispenser is provided at the door in communication with the cavity for supplying the ice to a user outside.

13 Claims, 7 Drawing Sheets

REFRIGERATOR WITH AN ICEMAKER

CROSS-REFERENCE TO RELATED APPLICATIONS

This application claims the benefit of Korean Application No. P2003-65162, filed on Sep. 19, 2003, which is hereby incorporated by reference as if fully set forth herein.

BACKGROUND OF THE INVENTION

1. Field of the Invention

The present invention relates to a refrigerator, and more particularly, to a refrigerator with an icemaker having a structure for supplying ice from an outside of the refrigerator through a dispenser.

2. Discussion of the Related Art

A refrigerator is an apparatus for taking storage of foods freshly for a long-term period. Such refrigerator has a food-storage chamber therein. The food-storage chamber is always maintained at a low temperature by a refrigerating cycle for keeping food fresh.

The food-storage chamber is divided into a plurality of storage chambers having different characteristics from each other such that a user can choose a food-storage method in consideration of a kind, a characteristic and an expiration date of food. Typical examples of the storage chambers are a cooling chamber and a freezer.

The cooling chamber keeps a temperature at about 3° C.–4° C. for keeping food and vegetables fresh for a long time. The freezer keeps a temperature at a sub-zero temperature for keeping and storing meat and fish frozen for a long time and making and storing ice. Generally, the cooling chamber is larger than the freezer and the freezer is provided on top of the cooling chamber.

Meanwhile, the refrigerator is developed for performing various additional functions besides a typical function thereof. For example, the user had to open a door and take out a water bottle kept in the cooling chamber to drink cold water kept in the cooling chamber hitherto.

However, a refrigerator having a water dispenser provided at an outside of the door for supplying cold water cooled by cool air of the cooling chamber is developed and the user can drink cold water at outside of the refrigerator without opening the door. Furthermore, a product with water purifying function being added to the water dispenser is being supplied.

The water dispenser generally includes a door enabling to open and close the cooling chamber so as to easily supply water stored in the cooling chamber to an outside thereof. The cooling chamber is provided at a bottom of the freezer and the water dispenser is provided at a relatively lower place. Therefore, there is an inconvenience that the user has to stoop his/her back for using the dispenser.

Meanwhile, the user often uses the ice when the user drinks water or beverage and when the user cooks food. However, in this case, there is an inconvenience that the user has to open the door and separates the ice stored in the ice tray from the ice tray for using the ice. Also, when the door is open for using the ice, cool air in the freezer leaks out to the outside thereof and the temperature of the freezer goes up. Therefore, compressor is required to work more and there is a problem that energy is wasted.

SUMMARY OF THE INVENTION

Accordingly, the present invention is directed to a refrigerator with an icemaker that substantially obviates one or more problems due to limitations and disadvantages of the related art.

An object of the present invention is to provide a refrigerator with an icemaker, the refrigerator having an improved structure and including a dispenser at a convenient height for a user to use.

Another object of the present invention is to provide a refrigerator with an icemaker, the refrigerator having an improved structure for supplying ice to a user at an outside thereof without opening the door.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, the refrigerator with an icemaker includes a cabinet, a case, a first duct, a second duct, an icemaker, an ice container, and a dispenser.

The cabinet includes a freezer and a cooling chamber. The case having a cavity therein is provided at a door opening and closing the cooling chamber. The first duct is provided in the cabinet for supplying cool air generated around an evaporator. The second duct is provided in the cabinet for supplying the cool air generated around the evaporator to the cavity. The icemaker is provided at the cavity for producing ice. The ice container is provided at the cavity for storing the ice. The dispenser is provided at the door to be able to communicate with the cavity for supplying the ice to the user at the outside.

The evaporator of the refrigerator according to the present invention is provided at the freezer. It is desirable that the case includes an insulating material. The case is provided at an upper part of the door. Meanwhile, the second duct is communicated with the cavity when the door is closed.

In the first embodiment of the present invention, the second duct is provided separately from the first duct. In this case, the second duct is provided at a left or right wall of the cooling chamber. The refrigerator according to the first embodiment further includes a damper provide adjacent to the evaporator for controlling an amount of the cool air supplied to the first duct and the second duct.

In the refrigerator according to the first embodiment of the present invention, the first duct is provided on an inner rear wall of the cooling chamber such that a first end of the first duct is adjacent to the evaporator and a second end of the first duct is communicated with the cooling chamber and the second duct is provided on an inner wall of the cooling chamber such that a first end of the second duct is adjacent to the evaporator and a second end of the second duct is communicated with the cavity.

In the second embodiment of the present invention, the first duct and the second duct are communicated with each other. In this case, the first duct is provided on a rear wall of the cooling chamber and the second duct is provided on a ceiling of the cooling chamber for communicating the first duct with the cavity. The refrigerator according to the second embodiment further includes a damper provided adjacent to the evaporator for controlling an amount of the cool air supplied to the first duct.

Meanwhile, in the refrigerator according to the present invention, the first duct includes a plurality of holes passing through an outer circumference thereof for supplying the cool air to everywhere of the cooling chamber.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A conventional refrigerator has a structure that a cooling chamber is provided at a lower part thereof and a freezer at an upper part thereof. However, the freezer is provided at a lower part of the refrigerator and the cooling chamber at an upper part thereof in the refrigerator according to the present invention.

Figure 1:
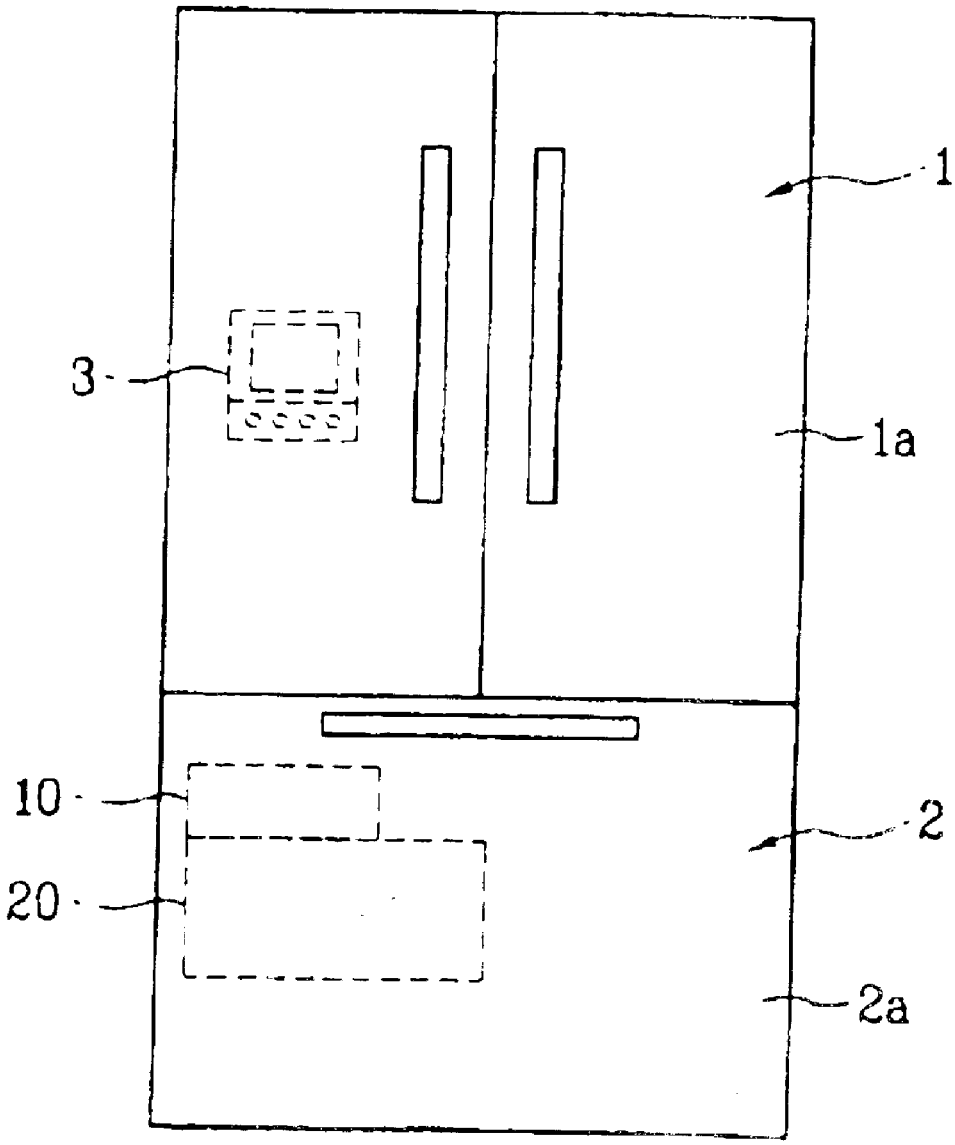
FIG. 1 illustrates a refrigerator according to the present invention.

Referring to FIG. 1, the refrigerator according to the preset invention includes a cooling chamber 1 provided at the upper part thereof and a freezer 2 at the lower part thereof. A door 1*a* is provided on a front surface of the cooling chamber 1 and a water dispenser 3 is provided at the door 1*a*.

The water dispenser 3 enables a user to be supplied with cold water at an outside without opening the door 1*a*. For this, a water tank is provided on an inner surface of the door 1*a*. The water tank (not illustrated) stores water and cool air in the cooling chamber 1 cools the water stored in the water tank. Accordingly, the user operates a lever (not illustrated) and is supplied with cold water stored in the water tank through the water dispenser 3.

As mentioned above, the refrigerator according to the present invention has a structure providing the cooling chamber 1 at the upper part of the refrigerator and the freezer 2 at the lower part thereof. Accordingly, the water dispenser 3 is provided at a waist height or a chest height. Therefore, it is easy and convenient for the user to use the dispenser 3 according to the present invention.

Meanwhile, in the refrigerator according to the present invention, not only the water dispenser 3 but also an icemaker 10 is provided. Hereinafter, the icemaker will be described referring to the drawings. As a reference, the icemaker and an ice container provided in the refrigerator of FIG. 1 are illustrated in FIGS. 2 and 3 and an operation of those is described in FIG. 4.

The icemaker 10 and the ice container 20 are provided in the freezer 2 provided at a lower part of the cooling chamber 1. The icemaker 10 includes an ice tray 11, a water supplier 12, an ejector 14 and a motor 13 as illustrated in FIG. 2. In this case, the ice tray 11 includes an open top and an interior formed as a semi cylindrical form for storing water and the ice inside thereof.

A plurality of ribs 11*a* is provided in the ice tray 11 for dividing the interior space into a plurality of sections. The plurality of ribs 11*a* protrudes from the inner surface of the ice tray 11 as illustrated in FIG. 2.

Figure 2:
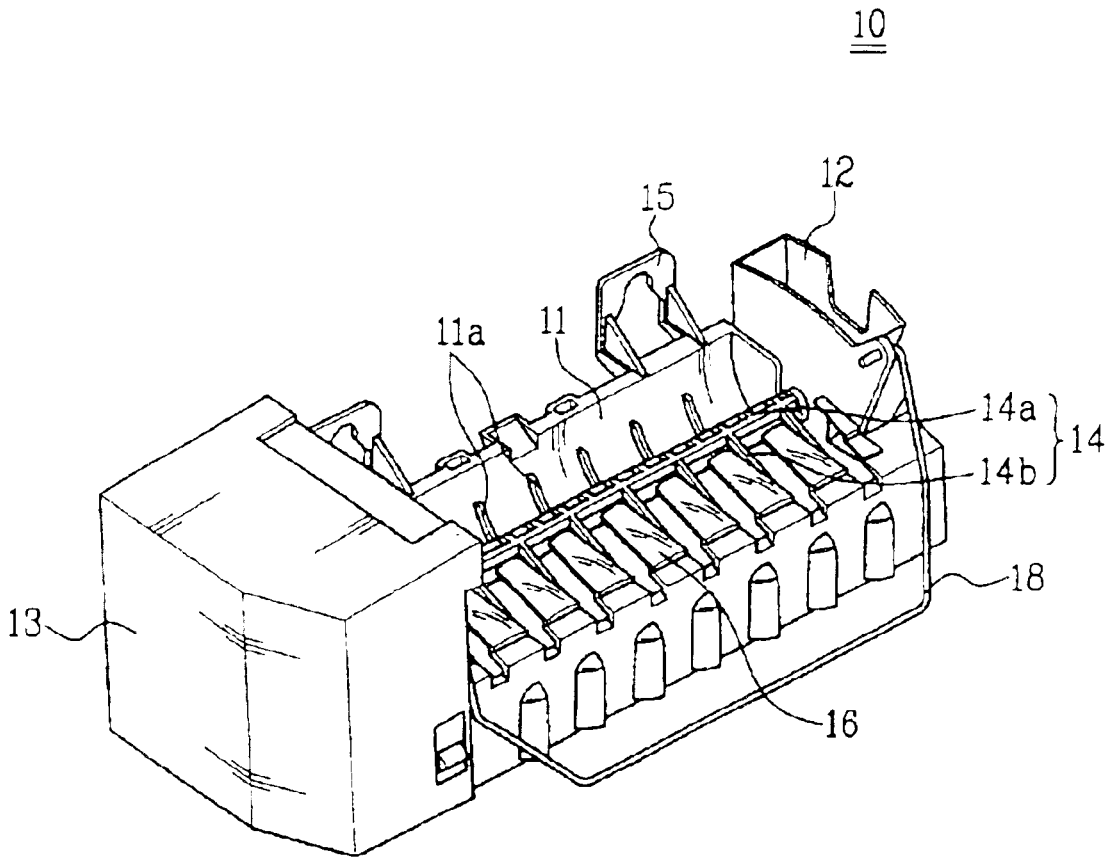
FIG. 2 illustrates a perspective view of an icemaker provided in the refrigerator of FIG. 1.
Figure 3:
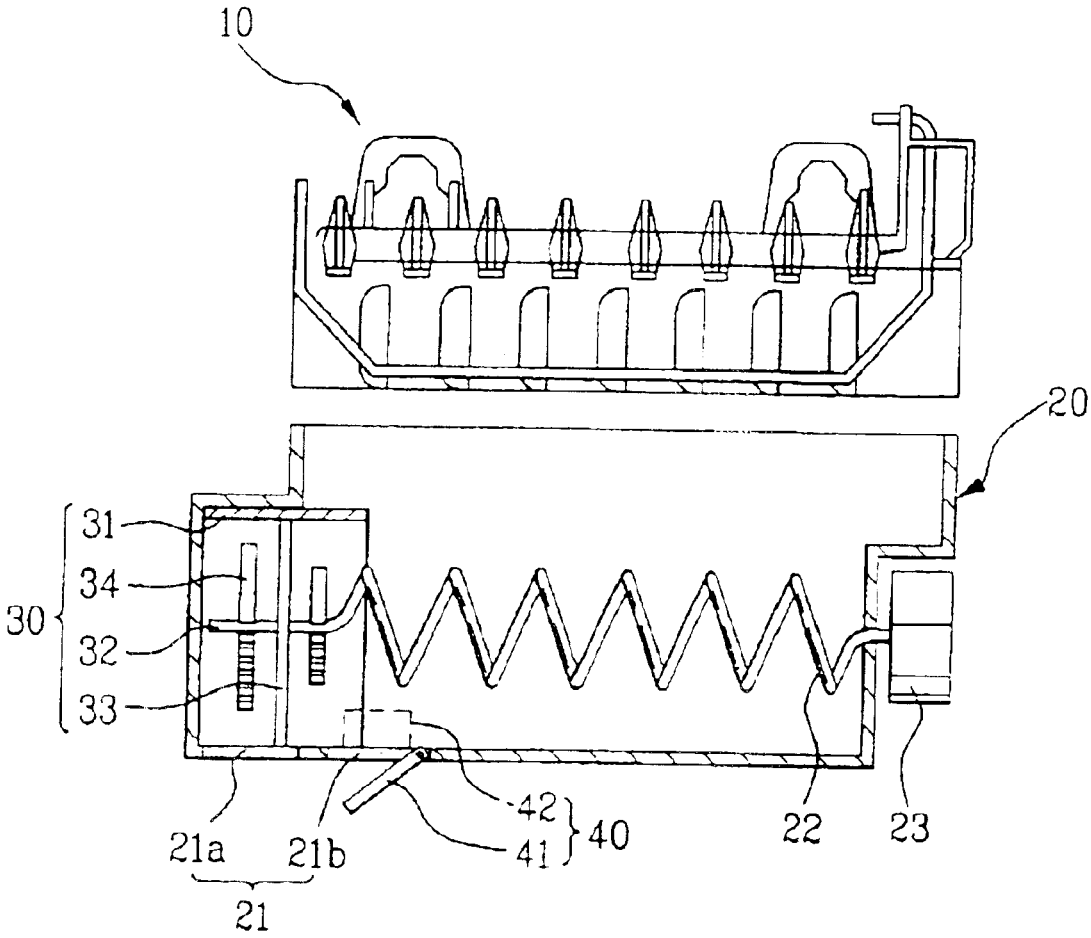
FIG. 3 illustrates a cutaway view of the icemaker and an ice container of FIG. 1.

The water supplier 12 is provided at a side of the ice tray 11 as illustrated in FIG. 2 for performing a role of supplying water to the ice tray 11. A bracket 15 is provided at a rear side of the ice tray 11 for fixing the icemaker 10 to the freezer as illustrated in FIG. 2.

Meanwhile, the ejector 14 includes a shaft 14*a* and a plurality of fins 14*b*. The shaft 14*a* as a central axis of the ejector 14 is placed to cross the center along the longitudinal direction at an upper inside of the ice tray 11. The plurality of fins 14*b* is extended in a radius direction on an outer circumferential surface of the shaft 14*a*. It is desirable that the plurality of fins 14*b* is provided at a same interval along the longitudinal direction of the shaft 14*a*. Particularly, each of the plurality of fins is placed in each section provided in the ice tray 11 by the ribs 11*a*.

The motor 13 is provided at a point of an outer circumferential surface of the ice tray 11 to be pivotly coupled with the shaft. Accordingly, when the shaft 14*a* is rotated via the motor 13, the plurality of fins 14*b* are rotated together. Each of the plurality of fins 14*b* pushes each ice in the ice tray 11 and drops to a lower part of the icemaker 10.

Referring to FIG. 3, a plurality of strips 16 is provided in a front part of the ice tray 11, i.e., at an upper end of a side opposite to a side where the bracket 15 is provided. Each of the plurality of strips 16 is extended from a front upper part of the ice tray 11 to a part around the shaft 14*a*. In this case, there is a little gap between each of the plurality of strips 16. The fins pass through the gap when the shaft 14*a* is rotated.

In the mean time, the ice in the ice tray 11 is pushed by the shaft 14*a*, separated from the ice tray 11 and dropped onto the plurality of strips 16 after being separated completely when the shaft 14*a* is rotated. The ices dropped onto the plurality of strips 16 are dropped again onto the lower part of the icemaker 10 to be stored in the ice container 20 provided at the lower part of the icemaker 10. Accordingly, an upper surface of the plurality of strips 16 leads the ice separated from the ice tray 11 to the lower part of the plurality of strips 16. Therefore, it is desirable that a side of the plurality of strips 16 adjacent to the shaft 14*a* slopes toward one side and thus the side of the plurality of strips 16 near the shaft 14*a* is arranged at a higher place than a front side of the ice tray 11.

A structure is required for preventing the ice from being dropped to a rear side of the ice tray 11, the ice separated from the ice tray 11. For this, it is desirable that a rear end of the ice tray 11 is provided to be higher than the shaft 14*a* as illustrated in FIG. 3 according to the present invention. Then, the ice moved to the rear side of the ice tray 11 by the plurality of fins 14*b* and separated from the ice tray 11 are smoothly leaded to the front side of the ice tray 11 and dropped onto the upper surface of the plurality of strips 16.

Figure 4:
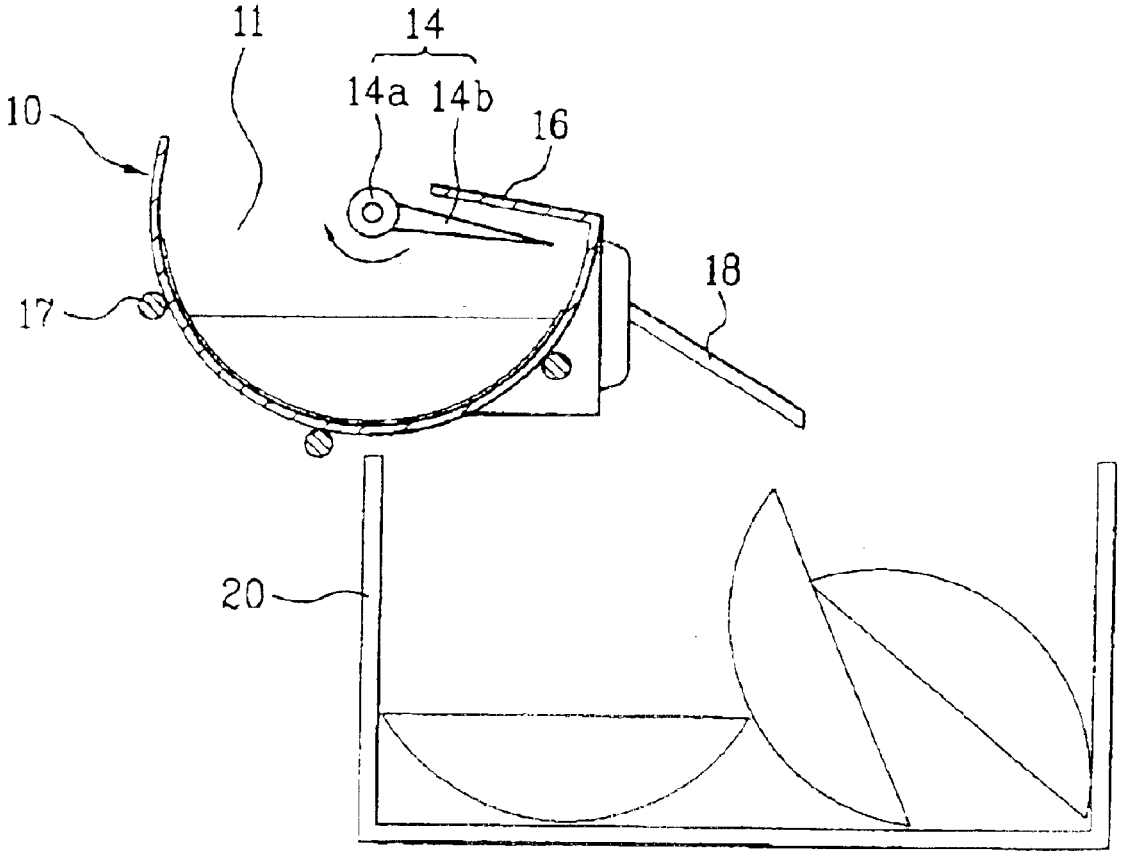
FIG. 4 illustrates a diagram showing an operation of the icemaker provided in the refrigerator of FIG. 1.

Meanwhile, a heater 17 is provided at a lower surface of the ice tray 11 as illustrated in FIG. 4. The heater 17 heats a surface of the ice tray 11 for a short time and slightly melts the ice on the surface of the ice tray 11. Accordingly, the ices in the ice tray are easily separated when the shaft 14*a* and the plurality of fins 14*b* rotate.

Referring to FIG. 2 to FIG. 4, a sensing arm 18 is provided in the icemaker 10 for estimating an amount of ices stored in the container 20. The sensing arm 18 is controlled by a controller (not illustrated) and moved up and down so as to estimate the amount of ices stored in the container 20. For example, the sensing arm 18 periodically descends. Descending amount is large when a small amount of ices is stored in the container 20. On the other hand, the sensing arm 18 is bumped into the ice and thus descending amount is small when a large amount of ices are stored in the container 20. Accordingly, the controller estimates the amount of ice in the ice container 20 with a descended amount.

Meanwhile, the container 20 provided at a lower part of the icemaker 10 has an open top for receiving and storing the ice dropped from the icemaker 10 as illustrated in FIG. 3 and FIG. 4. An outlet 21 is provided on a side of the ice container 20, for example, on a floor for discharging the ice to a lower part thereof as illustrated in FIG. 3.

In the mean time, a transporting device 22 is provided in the ice container 20 for transporting the ice stored in the container 20 toward a side of the outlet 21. The transporting device 22 is formed in a zigzag form and provided to cross an inside of the container 20. The transporting device 22 coupled to the motor 23 rotates and transports the ice stored in the container 20 toward the side of the outlet 21.

Referring to FIG. 3, a crusher 30 is provided at the side of the outlet 21 in the container 20. The crusher 30 includes a housing 31, a shaft 32, a supporter 33 and a blade 34.

The housing 31 is provided on top of the outlet 21 in the container 20 and a surface, i.e., a side facing the transporting device 22 is formed in an opened form.

The shaft 32 is perpendicularly provided in the housing 31 and coupled with and rotated together with the transporting device 22.

The blade 34 coupled with the shaft 32 crushes the ice transported by the transporting device 22 rotating together with the shaft 32. At least one blade 34 is provided. When a plurality of the blades is provided, it is desirable that the plurality of blades is provided at both sides around the supporter 33.

When the icemaker 10 and the ice container 20 are provided in the freezer 2, a plurality of pieces of ice produced from the icemaker 10 are stored in the ice container 20. Accordingly, it is convenient that the user opens the door 2*a* for opening the freezer 2 and takes out the plurality of pieces of ice stored in the ice container 20 to use needless to separate the ice from the ice tray. However, in this case, it is inconvenient that the door 2*a* should be opened and there is a problem that the energy is wasted because the door 2*a* is frequently opened.

Accordingly, although it is not illustrated, an ice dispenser is provided at the door 2*a* for opening and closing the freezer 2 in the refrigerator according to the present invention. In this case, the ice dispenser is separately provided from the water dispenser 3. The user is supplied with ice produced from the icemaker 10 and stored in the ice container 20.

For this, it is desirable that an ice discharger 40 is provided at the ice container 20 for selectively discharging an appropriated amount of ices. The ice discharger 40 includes an actuator 42 and a shutter 41 as illustrated in FIG. 3.

The shutter 41 formed in a plate form is provided for opening and closing the outlet 21. The actuator 42 is coupled with the shutter 41 via a lever (not illustrated). In this case, for example, a solenoid type actuator is employed as the actuator 41.

The ice discharger 40 composed as mentioned above, the actuator 42 operates according to a control signal of the controller and the shutter 41 controls an amount of opening and closing of the outlet 21 according to the actuator 42.

Meanwhile, it is desirable that the ice discharger 40 provided as mentioned above in the present invention is provided for selectively discharging the crushed ice crushed by the crusher 30 or the ice stored in the ice container 20.

For this, the outlet 21 includes a first outlet 21*a* and a second outlet 21*b* as illustrated in FIG. 3. The shutter selectively opens or closes the second outlet 21*b*. In this case, the first outlet 21*a* is provided at a lower part of the crusher 30 as illustrated in FIG. 3 and the second outlet 21*b* is provided at a lower end of the transporting device next to the crusher 30.

When the outlet 21 and the ice discharger 40 have the structure mentioned above, the ice discharger 40 selectively discharges the crushed or uncrushed ice. A brief description of this is as follows.

If the user wants to be supplied with the crushed ice, the shutter 41 closes the second outlet 21*b*. Then, the ice stored in the ice container 20 is transported to the crusher 30 via the transporting device 22 and the crushed ice via the crusher 30 is discharged through the opened first outlet 21*a*.

On the other hand, when the user wants to be supplied with uncrushed ice, the shutter 41 opens the second outlet 21*b*. Then, the ice stored in the ice container is discharged to the second outlet 21*b* before being transported to the crusher 30 via the transporting device 22. Accordingly, the user is supplied with uncrushed ice.

Meanwhile, the structure for selectively providing the crushed or uncrushed ice is not limited to the structure mentioned above. For example, one discharger and one shutter for controlling the amount of opening and closing the discharger can be provided. In other words, the ice is discharged after being crushed by the crusher 30 when the shutter slightly opens the discharger and the ice is discharged without being crushed when the shutter completely opens the discharger.

Hereinafter, an operation of the refrigerator composed as mentioned above according to the present invention will be described. First, when the controller determines via the sensing arm 18 that the ice in the ice container 20 is not enough, water is supplied to the water supplier 12. The water supplied to the supplier 12 is filled up the space between the each of the plurality of ribs 11*a* in the ice tray 11 and frozen by cool air of the freezer 2. Therefore, a plurality of pieces of ice having a predetermined size is produced via the ribs 11*a* in the ice tray 11.

When a predetermined time period is passed and ice is produced, the heater is heated for a shot period of time. Accordingly, the outer surface of the ice tray 11 is slightly melted and each of the ices is separated from the ice tray 11. Then the motor 13 is operated and the shaft is rotated together with the fin 14*b*. Then the plurality of fins 14*b* push the ice between each of the plurality of ribs 11*a* in a circumference direction of the ice tray 11 and the ice completely separated from the ice tray 11 via the plurality of fins 14*b* is dropped onto the dropper 16 and subsequently to the lower part of the icemaker 10. The ice dropped onto the lower part of the icemaker 10 is stored in the container 20.

When a predetermined amount of ice is filed up the container 20 by repeating the process mentioned above, the amount of ice is estimated via the sensing arm 18 and the controller stops the ice. Of course, when the sensing arm 18 determines that the amount of the ice is still not enough, the controller keeps producing the ice and storing the ice in the ice container 20 by repeating the process.

Meanwhile, if the user operates the control panel provided on the outer surface of the door 2*a* when the ice container 20 is filled up with the ice, the user is supplied with the crushed ice or uncrushed ice through the ice dispenser. Hereinafter, the process will be described.

When the user selects a function for supplying the crushed ice by operating the control panel, the shutter 41 closes the second outlet 21*b* or slightly opens the outlet 21. In this case, the motor 23 rotates and transports the large ice stored in the ice container 20 to the crusher 30. Then, all ice stored in the ice container 20 is transported to the crusher 30. Accordingly, the crushed ice crushed by the crusher 30 is discharged through the first outlet 21*a*. The discharged ice is supplied to the user through the ice dispenser.

On the other hand, when the user selects a function for supplying large and uncrushed ice by operating the control panel, the shutter 41 opens the second outlet 21*b* or mostly opens outlet 21. Then, the ice transported toward the crusher via the transporting device 22 is discharged through the outlet 21 before reaching the crusher 30 and is supplied to the user through the ice dispenser.

As aforementioned, the user is selectively supplied with crushed ice or uncrushed ice using the refrigerator according to the present invention. However, despite of the advantage, the refrigerator described referring to FIG. 1 to FIG. 4 according to the present invention has a few disadvantages as follows.

First, when the ice dispenser is not provided at the door for opening and closing the freezer, the door needs to be opened for taking out the ice. It is not only inconvenient but also wasting energy.

Second, when the dispenser is provided at the door for opening and closing the freezer, the freezer and the ice dispenser are provided at the lower part of the cooling chamber 1. In this case, it is inconvenient that the user needs to stoop down for being supplied with the ice.

Third, when the water dispenser and the ice dispenser are provided, there is a problem that the structure is very complicated for manufacturing and the prime cost is increased. And also, it is inconvenient for the user to use the water dispenser and the ice dispenser separately.

Accordingly, the refrigerator with an improved structure is provided for complementing the problem of the embodiment. The dispenser is provided at the door for opening and closing the cooling chamber provided on top of the freezer in the refrigerator according to the present invention. Accordingly, it is easy and convenient for the user to use the dispenser. Also, water stored in the water tank provided at the cooling chamber is supplied through the dispenser when the refrigerator has the structure. Therefore, the user is supplied with ice or water through one dispenser provided at a location corresponding a waist or chest of the user.

Figure 5:
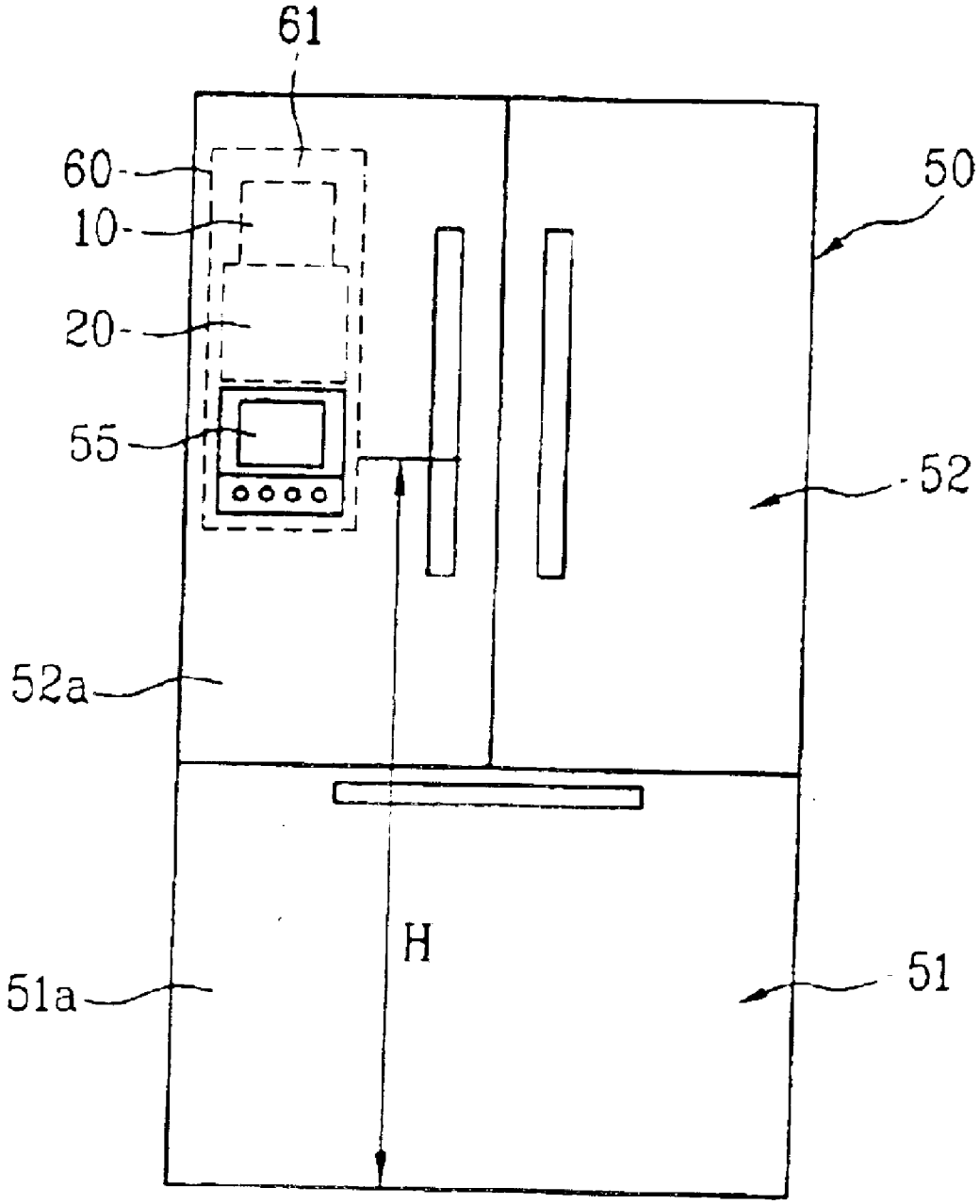
FIG. 5 illustrates a diagram showing an improved refrigerator according to the present invention.
Figure 6:
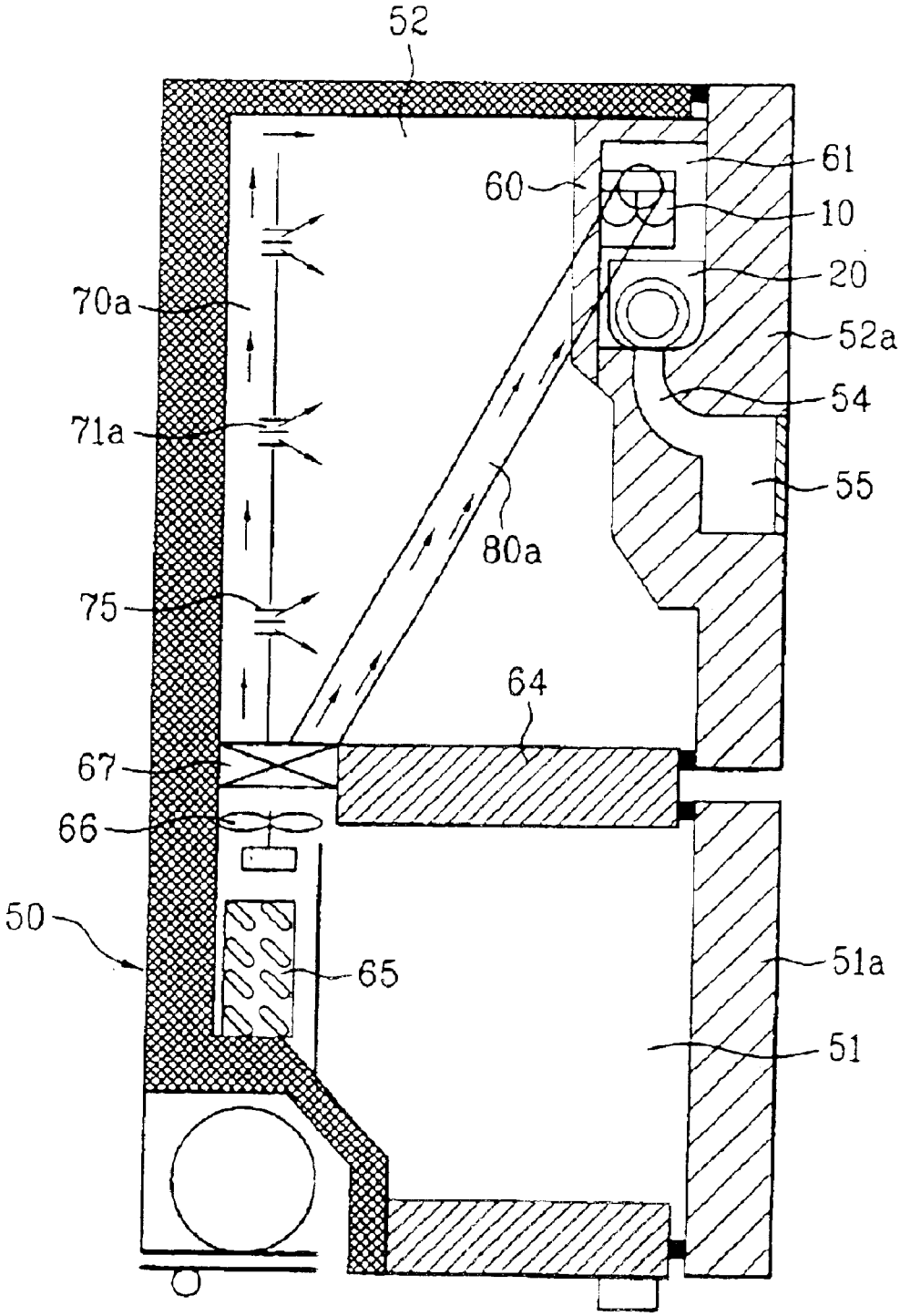
FIG. 6 illustrates a side sectional view showing a first embodiment of the refrigerator of FIG. 5.
Figure 7:
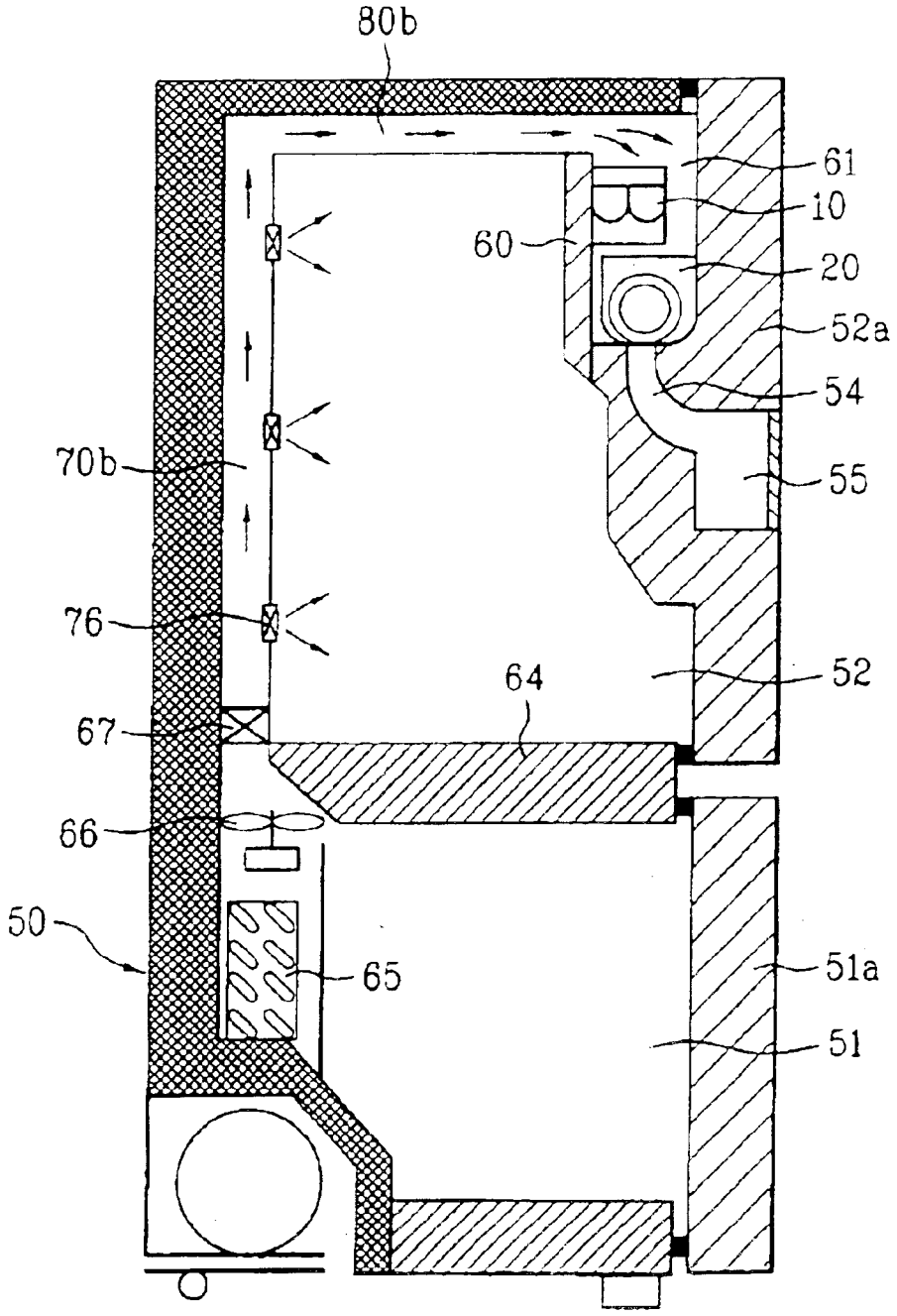
FIG. 7 is a side sectional view showing a second embodiment of the refrigerator of FIG. 5.

The refrigerator with the improved structure is illustrated in FIG. 5 to FIG. 7. Hereinafter, the structure of the improved refrigerator according to the present invention will be described referring to the drawings. As a reference, FIG. 5 is a diagram showing the improved refrigerator according to the present invention. FIG. 6 is a side sectional view showing a first embodiment of the refrigerator of FIG. 5. FIG. 7 is a side sectional view showing a second embodiment of the refrigerator of FIG. 5.

First, referring to FIGS. 5 and 6, the first embodiment will be described. Referring to FIGS. 5 and 6, a cooling chamber 52 is provided at upper part in a cabinet 50 and a freezer 51 is provided at lower part in the cabinet 50. In this case, the cooling chamber 52 and the freezer 51 are divided via a mullion 64 as illustrated in FIG. 6.

Referring to FIG. 6, an evaporator 65 is provided at the freezer 51 and a fan 66 is provided near the evaporator 65. Accordingly, cool air generated near the evaporator 65 is supplied to the freezer 51 and the cooling chamber 52. Meanwhile, the evaporator 65 is not provided at only the freezer 51. That is, although not illustrated, the evaporator can be provided at the cooling chamber. Furthermore, a plurality of evaporators 65 can be provided at the freezer 51 and the cooling chamber 51. However, an embodiment providing one evaporator 65 at the freezer 51 is illustrated in FIG. 6. Hereinafter, the embodiment will be described.

Meanwhile, Referring to FIG. 5 and FIG. 6, a door 52*a* and 51*a* is provided at each freezer 52 and the freezer 51. In this case, a case 61 and a dispenser 55 are provides at the door opening and closing the cooling chamber 52. An icemaker 10 and an ice container 20 are provided in the case 61.

The case 61 is provided at the door 52*a* as illustrated in FIG. 6. In this case, The case 61 includes an insulating material and performs a role of preventing heat exchange between the cooling chamber 52 and the cavity 61.

The case 61, for example, is provided at an upper part of the door 52*a* as illustrated in FIG. 6. This is for providing the dispenser 55 at a convenient position for the user to use, i.e., at a waist or chest height in an average height of the users of the refrigerator.

In other words, if the case 61 is provided at a high place, an appropriate height for providing the dispenser 55 supposedly provided at a lower part of the case 61 is easily secured. Meanwhile, the appropriate height is set not as the waist or chest height, but according to other standard.

The cavity 61 is provided in the case 61 and the icemaker 10 and the ice container 20 are provided at the cavity 61. In this case, the structure of the icemaker 10 and the ice container 61 is the same as mentioned above referring to FIG. 2 to FIG. 4 and description of which will be omitted. Only, the icemaker 10 is provided at the lower part of the cavity 61 and at the lower part of the ice container 20 as illustrated in FIG. 6. Then, the ice produced from the icemaker 10 is dropped onto the lower part thereof and stored in the ice container 20.

The dispenser 55 is provided at the door 52*a* for opening and closing the cooling chamber 52 as illustrated in FIG. 6. An ice chute 54 is provided in the door 52*a* for communicating the cavity 61 and the dispenser 55. Accordingly, the ice stored in the ice container 20 is supplied to the user through the dispenser 55 after passing through the ice chute 54.

Meanwhile, referring to FIG. 6, a first duct 70*a* and a second duct 80*a* are provided in the cabinet 50. The first duct 70*a* and the second duct 80*a* are separately provided in the first embodiment and are not communicated each other. Hereinafter, the first duct 70*a* and the second duct 80*a* will be described in more detail.

In the refrigerator according to the first embodiment, the first duct 70*a* is provided for supplying cool air generated around the evaporator 65 to the cooling chamber 52 as illustrated in FIG. 6. For this, a first end of the first duct 70*a* is provided adjacent to the evaporator 65 and a second end of the first duct 70*a* is provided to communicate with the cooling chamber 52. The first duct 70*a*, for example, is provided at a rear wall of the cooling chamber 52 as illustrated in FIG. 6.

In the mean time, a plurality of holes 70*a* passing through an outer circumference of the first duct 70*a* is provided at the first duct 70*a*. Accordingly, cool air moving through the first duct 70*a* is supplied to everywhere of the cooling chamber 52 through the plurality of holes 71*a*. Meanwhile, a louver 75 is provided at each of the holes 71*a*. When the louver 75 is provided, a direction of cool air flowing to the cooling chamber through the holes 71*a* is controlled. Therefore, cool air is supplied to everywhere of the cooling chamber 52.

In the mean time, although it is not illustrated, a damper 76 is provided at the holes 71*a* as illustrated in FIG. 7. When the damper 76 is provided at the holes 71*a*, an amount of the cool air supplied to the cooling chamber 52 is controlled. And also, the cool air is, of course, prevented from being supplied to the cooling chamber 52 through the holes 71*a*.

In the refrigerator according to the first embodiment, the second duct 80*a* is provided for supplying the cool air generated around the evaporator 65 to the cavity 61. For this, a first end of the second duct 80*a* is arranged to be adjacent to the evaporator 65 provided in the cooling chamber and the second end of the second duct 80*a* is provided to communicate with the cavity 61.

In this case, the second duct 80*a* separated from the case 61 is not communicated with the cavity 61 when the door 52*a* is open. The second duct 80*a* is communicated with the cavity 61 only when the door 52*a* is closed. Therefore, although not illustrated, it is desirable that a gasket (not illustrated) is provided at a joint of the second duct 80*a* and the case 61. Then the cool air is effectively prevented from being leaking to outside when the door 52*a* is closed.

The second duct 80*a* provided in the cabinet 50 as aforementioned can be provided on an inner wall of the cooling chamber, in more detail, on a left wall or right wall of the cooling chamber 52. The second duct 80*a*, of course, can be provided on both left and right walls of the cooling chamber 52.

The second duct 80*a* performs a role of supplying the cool air to the cavity 61. Accordingly, a length of the second duct 80*a* needs to be short for minimizing a heat loss generated at the second duct 80*a*. Therefore, the second duct 80*a* is provided as an inclined straight-line form on a sidewall of the cooling chamber 52 as illustrated in FIG. 6.

Meanwhile, referring to FIG. 6, the damper 67 is provided between the evaporator 65 and the first and second ducts 70*a* and 80*a*. The damper 67 performs a role of controlling the amount of the cool air generated around the evaporator 65 and supplied to the second duct 80*a*. Accordingly, the cool air generated around the evaporator 65 is selectively supplied to the first duct or the second duct 80*a*, or supplied to both the first duct and the second duct 80*a*. Of course, the cool air may not be supplied to the first and second ducts 70*a* and 80*a*. When the damper 67 is provided, the cooling chamber and the cavity 61 are effectively controlled for maintaining different temperatures.

In the mean time, the refrigerator according to the second embodiment of the present invention is illustrated in FIG. 7. Although a structure of the refrigerator according to the second embodiment is similar to the refrigerator according to the first embodiment as illustrated in FIG. 6, installing locations of the first and second ducts 70*b* and 80*b* and coupling relations are different from each other. Hereinafter, the first and second ducts 70*b* and 80*b* of the refrigerator according to the second embodiment will be described.

Referring to FIG. 7, in the refrigerator according to the second embodiment, the first and second ducts 70*b* and 80*b* are communicated with each other.

In this case, a first end of the first duct 70*b* is provided adjacent to the evaporator 65 and a second end of the first duct 70*b* is provided in the cooling chamber 52. It is desirable that the first duct 70*b* is provided on a rear wall of the cooling chamber 52 as illustrated in FIG. 7 and the second end of the first duct 70*b* is provided at the upper part of the cooling chamber 52.

Meanwhile, the plurality of holes is provided at the first duct 70*b*. The holes are for supplying cool air to the cooling chamber 52 through the first duct 70*b*. A damper 76 is provided at the holes as illustrated in FIG. 7. When the damper 76 is provided at the holes, the amount of cool air supplied to the cooling chamber 52 through the holes is controlled. In the mean time, although it is not illustrated, the louver is provided at the holes as illustrated in FIG. 6.

The first end of the second duct 80*b* is coupled with the second end of the first duct 70*b* and the second end of the second duct 80*b* is coupled with the cavity 61. It is desirable that the duct 80*b* is provided on a ceiling of the cooling chamber 52 as illustrated in FIG. 7.

The second duct 80*b* is coupled with the cavity 61 when the door 52*a* is closed as the same as in the first embodiment described with reference to FIG. 6. Accordingly, it is desirable that the gasket is provided at the joint of the second duct 80*b* and the case 61 when the door 52*a* is closed.

In the refrigerator according to the second embodiment, the damper 67 is provided between the first duct 70*b* and the evaporator 65. The damper 67 is provided adjacent to the evaporator 65 for performing a role of controlling the amount of the cool air generated around in a neighborhood of the evaporator 65 and supplied to the first duct 70*b*.

Meanwhile, although not illustrated, the water tank (not illustrated) is further provided in the refrigerator in accordance with the first and second embodiments. The water tank is provided at the cooling chamber 52 for performing a role of supplying water cooled by the cool air in the cooling chamber 52 to the dispenser 55. When the water tank is further provided, the user is selectively supplied with ice or water through the dispenser 55.

Hereinafter, an operation of the refrigerator according to the first and second embodiments.

First, when it is determined via the sensing arm 18 that the ice is not enough in the ice container 20, water is supplied to the ice tray 11 and cool air generated around the evaporator 65 is supplied to the cavity 61. In a case of the first embodiment, the cool air is supplied to the cavity 61 through the second duct 80*a*. In a case of the second embodiment, the cool air is supplied to the cavity 61 after passing through the first duct 70*b* and the second duct 80*b*. In the case of the second embodiment, when the cool air is supplied to the cavity 61, the damper 76 blocks the cool air from being supplied to the cooling chamber 52 through the holes or reduces the amount of cool air to be supplied.

When the cool air is supplied to the cavity 61, the icemaker 10 produces ice and the produced ice is stored in the ice container 20. The ice stored in the ice container 20 is supplied to the user either in a crushed or uncrushed state. The process is the same as mentioned above and detailed description of the process will be omitted.

Meanwhile, the cavity needs to be maintained at a below zero temperature for preventing the ice from being melted. Therefore, the control member (not illustrated) supplies the cool air to the cavity 61 when the temperature of the cavity is out of a preset temperature range.

In the mean time, when the temperature of the cavity is out of the preset temperature range, the control member supplies the cool air to the first duct 70*a* and 70*b* by controlling the damper 67. Therefore, the cool air supplied to the first duct 70*a* and 70*b* is supplied to the cooling chamber 52 through the holes 71*a*.

In the refrigerator of the present invention, the control member effectively controls the temperature of cooling chamber 52 and the cavity 61 by controlling the damper 67 as mentioned above. The refrigerator according to the present invention has following advantages.

First, it is convenient for the user to use because the dispenser is provided at a waist height or chest height. Second, it is convenient that the ice or water is supplied to the outside without opening the door. Third, the icemaker and the ice container are provided in the door. Therefore, a size of the freezer consuming a great amount of energy is reduced. By increasing the size of the cooling chamber, the space is effectively used.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerator with an icemaker, comprising:

a cabinet having a freezer and a cooling chamber;

a case provided at a door selectively opening and closing the cooling chamber and having a cavity therein;

a first duct provided in the cabinet for supplying cool air generated around an evaporator to the cooling chamber;

a second duct provided in the cabinet for supplying cool air generated around an evaporator to the cavity;

an icemaker provided at the cavity for producing the ice;

an ice container provided at the cavity for storing the ice; and a dispenser provided at the door for communicating with the cavity.

2. The refrigerator with the icemaker of claim 1, wherein the evaporator is provided at the freezer.

3. The refrigerator with the icemaker of claim 1, wherein the case comprises an insulating material.

4. The refrigerator with the icemaker of claim 1, wherein the case is provided at an upper part of the door.

5. The refrigerator with the icemaker of claim 1, wherein the second duct is communicated with the cavity when the door is closed.

6. The refrigerator with the icemaker of claim 1, wherein the second duct and the first duct are provided separately.

7. The refrigerator with the icemaker of claim 6, wherein the second duct is provided on a left or right wall of the cooling chamber.

8. The refrigerator with the icemaker of claim 6, further comprising a damper provided adjacent to the evaporator for controlling an amount of the cool air supplied to the first duct and the second duct.

9. The refrigerator with the icemaker of claim 6, wherein the first duct is provided on an inner rear wall of the cooling chamber such that a first end of the first duct is adjacent to the evaporator and a second end of the first duct is communicated with the cooling chamber and the second duct is provided on an inner wall of the cooling chamber such that a first end of the second duct is adjacent to the evaporator and a second end of the second duct is communicated with the cavity.

10. The refrigerator with the icemaker of claim 1, wherein the first duct comprises a plurality of holes passing through an outer circumference thereof for supplying the cool air to the cooling chamber.

11. The refrigerator with the icemaker of claim 1, wherein the first duct and the second duct are communicated with each other.

12. The refrigerator with the icemaker of claim 11, wherein the first duct is provided on a rear wall of the cooling chamber and the second duct is provided on a ceiling of the cooling chamber for communicating the first duct with the cavity.

13. The refrigerator with the icemaker of claim 11, further comprising a damper provided adjacent to the evaporator for controlling an amount of the cool air supplied to the first duct.

* * * * *